US010279982B2

(12) United States Patent
Hanssen

(10) Patent No.: US 10,279,982 B2
(45) Date of Patent: May 7, 2019

(54) CONTAINER FOR LIQUIDS

(71) Applicant: Eurokeg B.V., Den Helder (NL)

(72) Inventor: Hubert Joseph Frans Hanssen, Badhoevedorp (NL)

(73) Assignee: EUROKEG B.V., Den Helder (NL)

( * ) Notice: Subject to any disclaimer, the term of this patent is extended or adjusted under 35 U.S.C. 154(b) by 0 days.

(21) Appl. No.: 14/417,408

(22) PCT Filed: Jul. 22, 2013

(86) PCT No.: PCT/EP2013/065440

§ 371 (c)(1),
(2) Date: Jan. 26, 2015

(87) PCT Pub. No.: WO2014/016261

PCT Pub. Date: Jan. 30, 2014

(65) Prior Publication Data

US 2015/0191297 A1 Jul. 9, 2015

(30) Foreign Application Priority Data

Jul. 27, 2012 (EP) ..... 12178370

(51) Int. Cl.
*B65D 83/42* (2006.01)
*B65D 21/02* (2006.01)
*B65D 83/38* (2006.01)

(52) U.S. Cl.
CPC ..... *B65D 83/425* (2013.01); *B65D 21/0224* (2013.01); *B65D 83/38* (2013.01)

(58) Field of Classification Search
USPC ..... 206/139, 427; 220/23.6
See application file for complete search history.

(56) References Cited

U.S. PATENT DOCUMENTS 1,770,163 A 7/1930 McCrery
2,995,272 A * 8/1961 Larson ..... B65D 1/243 206/139
RE27,212 E * 11/1971 Brown ..... B65D 71/10 206/139

(Continued)

FOREIGN PATENT DOCUMENTS

CN 102040023 5/2011
DE 102009044314 4/2011

(Continued)

OTHER PUBLICATIONS

Notification of Transmittal of the International Preliminary Report on Patentability for corresponding international application No. PCT/EP2013/065440, filed Jul. 22, 2013.

(Continued)

*Primary Examiner* — James N Smalley
*Assistant Examiner* — Madison L Poos
(74) *Attorney, Agent, or Firm* — Steven M. Koehler; Westman, Champlin & Koehler, P.A.

(57) ABSTRACT

The invention relates to a container assembly for liquids, such as beverages and oils, comprising a container, chimes and a valve assembly for feeding a propellant to and dispensing the liquid from the container. A portion of the assembly has a polygonal cross-section, which cross-section at least partially circumscribes the cross-section(s) of the remainder of the assembly.

19 Claims, 5 Drawing Sheets

(56) References Cited

U.S. PATENT DOCUMENTS

| | | | | |
|---|---|---|---|---|
| 3,683,549 | A | 8/1972 | Simmon | |
| 4,739,884 | A | 4/1988 | Duplessy | |
| 5,031,761 | A | 7/1991 | de Larosiere | |
| 5,687,847 | A | 11/1997 | Culpepper et al. | |
| 5,709,252 | A * | 1/1998 | Princiotta | B60P 3/055 108/55.3 |
| 6,302,291 | B1 | 10/2001 | McCleerey | |
| 6,666,358 | B1 | 12/2003 | Field | |
| 7,757,862 | B2 | 7/2010 | Tamura et al. | |
| 2001/0015331 | A1 | 8/2001 | Przytulla | |
| 2005/0189243 | A1 * | 9/2005 | Manabe | B65D 21/0204 206/139 |
| 2006/0081660 | A1 | 4/2006 | Harvey | |
| 2009/0050519 | A1 | 2/2009 | Tamura et al. | |
| 2010/0018994 | A1 * | 1/2010 | Antheil | B65D 21/0231 222/105 |
| 2010/0077790 | A1 | 4/2010 | Apps | |
| 2010/0089488 | A1 | 4/2010 | Veenendaal | |
| 2010/0320214 | A1 | 12/2010 | Wauters | |
| 2011/0108513 | A1 * | 5/2011 | Peter | B65D 21/0204 215/376 |

FOREIGN PATENT DOCUMENTS

| | | |
|---|---|---|
| EP | 0389191 | 9/1990 |
| FR | 1412075 | 9/1965 |
| GB | 2414016 | 11/2005 |
| GB | 2446393 | 8/2008 |
| JP | H02112835 A | 4/1990 |
| JP | H0468825 A | 3/1992 |
| JP | H08510430 A | 11/1996 |
| JP | 2005047574 A | 2/2005 |
| JP | 2005187001 A | 7/2005 |
| JP | 2009049169 A | 3/2009 |
| WO | 0007902 | 2/2000 |
| WO | 2010123864 | 10/2010 |
| WO | 2011101814 | 8/2011 |
| WO | 2011134949 | 11/2011 |

OTHER PUBLICATIONS

International Search Report for corresponding international application No. PCT/EP2013/065440, filed Jul. 22, 2013.

Examination Report for New Zealand application No. 704097, dated Oct. 10, 2016.

Patent Examination Report No. 1 from IP Australia for patent application No. 2013295080, dated Jun. 9, 2016.

New Zealand First Examination Report for related International application No. PCT/EP2013/065440, dated Feb. 19, 2016.

Second Office Action for Chinese Patent Application No. 201380039229, dated Apr. 19, 2017.

Office Action from Japanese Patent Application No. 2015-523518, dated Jun. 12, 2017, 6 pages.

* cited by examiner

CONTAINER FOR LIQUIDS

CROSS-REFERENCE TO RELATED APPLICATION

The present application is a national stage filing of International patent application Serial No. PCT/EP2013/065440, filed Jul. 22, 2013, and published as WO 2014/016261 A1 in English.

BACKGROUND

The discussion below is merely provided for general background information and is not intended to be used as an aid in determining the scope of the claimed subject matter.

Aspects of the invention relate to a container assembly for liquids, such as beverages and oils, comprising a container, chimes and a valve assembly for feeding a propellant to and dispensing the liquid from the container. The invention further relates to a group of container assemblies, e.g. stacked on a pallet.

WO 2011/134949 relates to a container for liquids, such as beverages and oils, comprising a blow molded polyester casing, a valve for dispensing the liquid from the container, and an inlet for introducing a propellant. The casing is enveloped by a stretch blow molded polyester shell. Further, in an embodiment, the top and the base of the shell are shaped to render the container stackable, as shown in FIG. 4 of WO 2011/134949.

It is explained in WO 2011/134949 that containers having a relatively high length to width ratio (L/D) and/or a relatively long cylindrical portion facilitate logistics, e.g. more containers can be placed on a pallet, and facilitate cooling, e.g. four containers fit in a standard size refrigerator.

DE 10 2009 044 314 addresses the problem of providing a stacking aid for kegs, in particular kegs made from a synthetic material, such as PET, PP or PEN, to enable secure and economical stacking of kegs on a pallet.

To this end, DE 10 2009 044 314 provides a stacking aid for containers having a first dome-shaped region (top 7 in FIG. 1 of DE 10 2009 044 314) and a second dome-shaped region (bottom 9). The stacking aid comprises a first element releasably positioned on the first dome-shaped region and a second element releasably positioned on the second dome-shaped region.

On pallets, container assemblies such as kegs are subjected to considerable forces, in particular during transport.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background. A container assembly is described where a portion of the assembly has a polygonal cross-section, which cross-section, when viewed from above, at least partially, preferably substantially entirely, circumscribes the cross-section(s) of the remainder of the assembly.

In an embodiment, the polygonal cross-section comprises at least two pairs of parallel sides, the pairs preferably extending at a right angle (square, octagon) or −120° (hexagon) with respect to each other.

The polygonal cross-section, such as square, hexagonal or octagonal cross-sections having e.g. straight or curved sides, provide abutment, in particular between surfaces or lines (not merely points) of adjacent container assemblies, and a degree of coherence within the layers of a stack on a pallet. Preferably, abutting polygons limit, at least through increased friction, rotation and translation (shifting) of the container assemblies relative to each other, in particular during transport.

Further, the polygonal cross-section hinders rolling of the container assembly over a floor and helps prevent any damage that may result from such rolling.

In a further embodiment, at least two, preferably four of the sides of the polygonal cross-section comprise self-complementary interlocking features, i.e. features isomorphic to their complement, thus further increasing stability in layers of such container assemblies e.g. when stacked on a pallet.

In an embodiment, at least one of the chimes, preferably the top chime, has a polygonal cross-section, i.e. forms a or the portion of the container assembly.

In a further embodiment, at least one of the chimes is a separate element attached, e.g. screwed and/or snap fitted, to the container, preferably about the valve, providing protection, and preferably releasably, to allow removal when the container is scrapped after use.

In an embodiment, the container or at least one of the chimes comprises one or more notches or at least one of the chimes diverges, thus defining a recess for accommodating a tensioning element. Thus, container assemblies in a layer of a stack on a pallet can be pulled together to further increase coherence within the layers.

In another embodiment, one of the chimes of the container assembly comprises an annular rim and the other chime comprises an annular step or groove suitable for accommodating an identical annular rim, thus increasing stackability and coherence between layers in a stack on a pallet.

In an embodiment, rigidity of the rim is increased by imposing undulation on the rim, preferably partially beyond the circumference of main part of the container, and/or by embossing the bottom chime of the container, near or at the rim.

In addition to contributing to stackability and palletization, in an embodiment, the chime provides at least one grip for lifting and manipulating the container assembly.

The invention further relates to a group of container assemblies. In an embodiment, the container assemblies are stacked in layers on a pallet, such as a Europallet or block pallet, and juxtaposed assemblies in a, preferably all, layers abut, and optionally interlock, at their polygonal cross-sections.

In a further embodiment, the container assemblies in at least one, preferably all layers in the stack are urged together by means of an elongate tensioning element, such as a strap or cord tensioned about the chimes of the outer container assemblies in the layer.

In an embodiment, a sheet of a flexible and/or plastically deformable material, in particular a polymer film or a hollow-core plate, is present between the layers. By placing a next layer of container assemblies on a flexible sheet, the sheet will be deformed, i.e. caught between the top and bottom chimes of stacked layers of container assemblies, and draw the assemblies within the layers together.

In another embodiment, the container assemblies are empty, i.e. do not contain a liquid, and positioned upside down. This orientation provides improved hygiene and facilitates filling of the container assemblies, in that the container assemblies need not be turned upside down at the bottling facility.

In a further embodiment, the container comprises an inner casing for holding the liquid and an outer shell enveloping the casing. In a further embodiment, the shell comprises two separate parts, e.g. divided along a circumference of the shell, and at least one of the parts, preferably the top part, is clamp fitted on the casing when the latter is pressurized. The remaining part of the shell can be secured, e.g. by clamping, cementing and/or welding, in the bottom end of the top part, e.g. upside down, as will be explained in the examples.

BRIEF DESCRIPTION OF THE DRAWINGS

Aspects of the invention will now be explained in more detail with reference to the drawings, which show a preferred embodiment of the present invention.

The drawings are not necessarily to scale and details, which are not necessary for understanding the present invention, may have been omitted. Further, elements that are at least substantially identical or that preform an at least substantially identical function are denoted by the same numeral.

DETAILED DESCRIPTION OF THE ILLUSTRATIVE EMBODIMENTS

Figure 1:
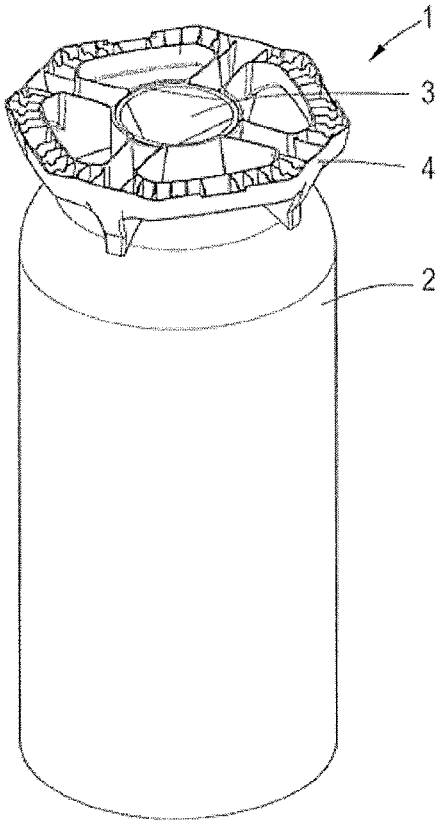
FIG. 1 is a perspective view of a container assembly provided with a multifunctional chime.

FIG. 1 shows a container assembly 1 for a beverage containing a gas, in particular beer, comprising a container 2 made by stretch blow molding polyester preforms, in particular PET (polyethylene terephthalate), a valve assembly 3, and a top chime 4 fitted about the valve assembly.

Figure 2:
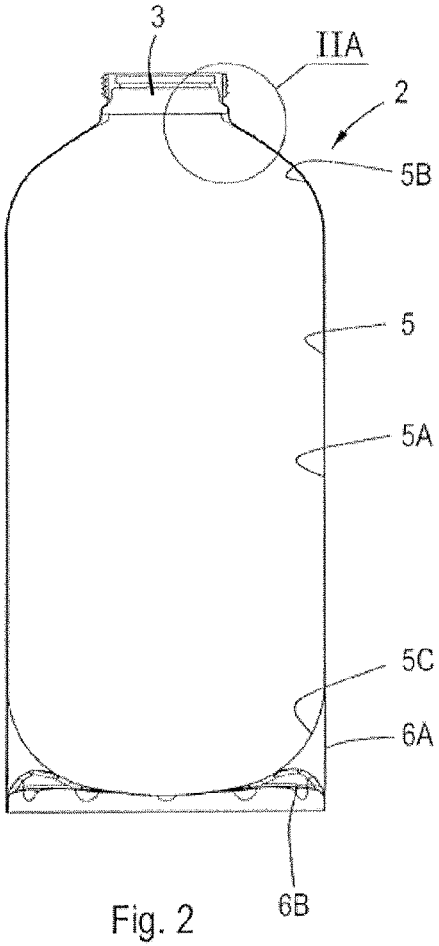
FIGS. 2 and 2A are cross-sections of the container of the container assembly shown in FIG. 1.
Figure 3:
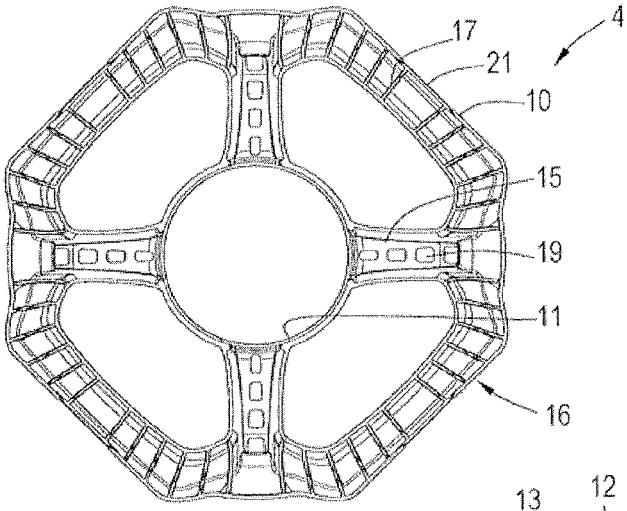
FIGS. 3 to 5 are a top view and perspective side views of the multifunctional chime of the assembly shown in FIG. 1.

As shown in FIGS. 2 and 3, in this example, the container 2 comprises an inner casing 5 for holding the liquid and an outer shell 6 enveloping the inner casing. The casing has smooth shape, defined by a cylinder 5A and upper and lower domes 5B, 5C to withstand internal pressure, and a central opening 7 in the top dome 5B formed by the non-deformed part of the preform. The valve assembly 3 is attached to this part.

The shell comprises two parts 6A, 6B, separated along a circumference, i.e. in hoop direction, of the shell 6, relatively close to the bottom of the shell, such that the top part of the shell is longer than the casing 5. The top part 6A of the shell comprises a central opening 7 surrounding the valve assembly 3 and provided with an external thread 8. The bottom part 6B of the shell provides a petaloid foot fitted, upside down, in the top part of the shell, forming a annular rim, as will be explained more detail below.

For more detailed information on the valve assembly and other suitable valve assemblies reference is made to International patent application WO 00/07902 (see especially page 8, line 12 ff. in conjunction with FIGS. 4A and 4B). In this example, a riser pipe (not shown) or a gastight bag (not shown) for receiving the beverage is connected to the valve assembly and located inside the casing. Further details on the bag can be found in inter alia WO 2011/134949.

Figure 2A:
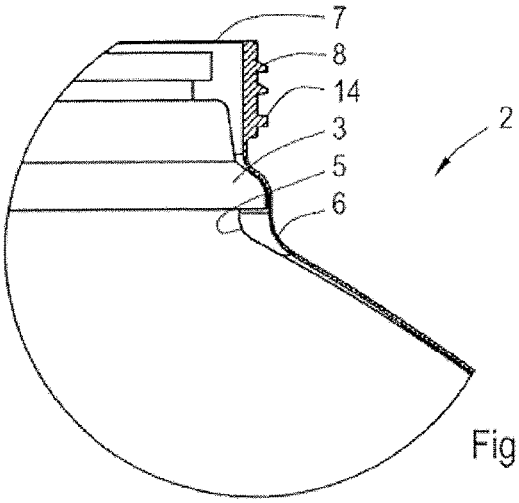
Figure 4:
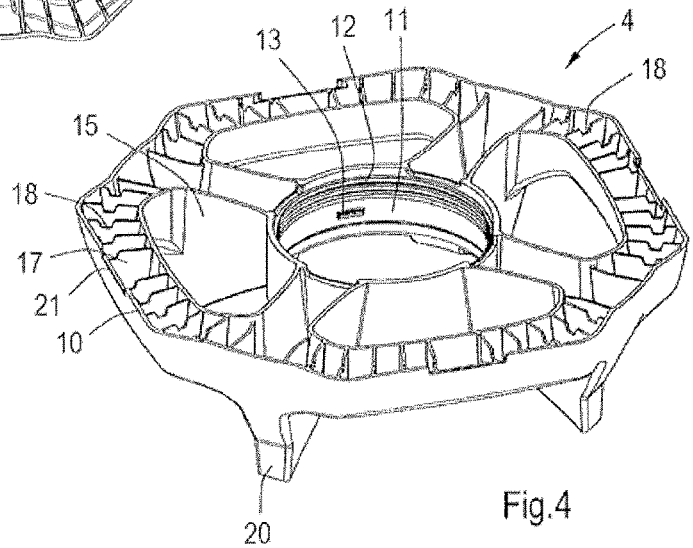
Figure 5:
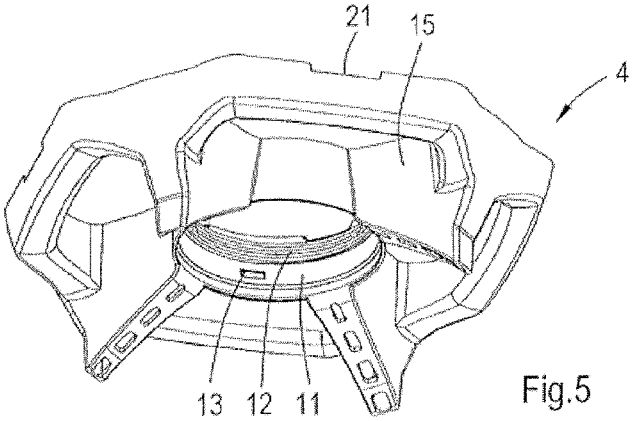

The top chime 4 is shown in more detail in FIGS. 3 to 5. The chime 4 comprises an octagonal rim, defining an octagonal circumference circumscribing the circular circumference of the container 2 and providing four sides 10 for abutting identical chimes of one or more neighboring container assemblies. The chime further comprises a central cylinder 11 providing a circular opening and an internal thread 12 to screw the chime onto the central opening 7 of the shell 6 and thus about the valve assembly 3 of the casing 5. The inner wall of the central opening 7 is preferably also provided with one or more slots 13 which snap onto corresponding protrusions 14 (FIG. 2A) on the outer wall of the central opening of the shell, thus establishing a final position of the chime on the container.

In this example, the rim is interconnected with the central cylinder 11 via a plurality of, e.g. four spokes 15, defining an equal number of grips 16 between the spokes. The rim and spokes are essentially hollow and stiffened by means of baffles 17 extending substantially radially.

Figure 8:
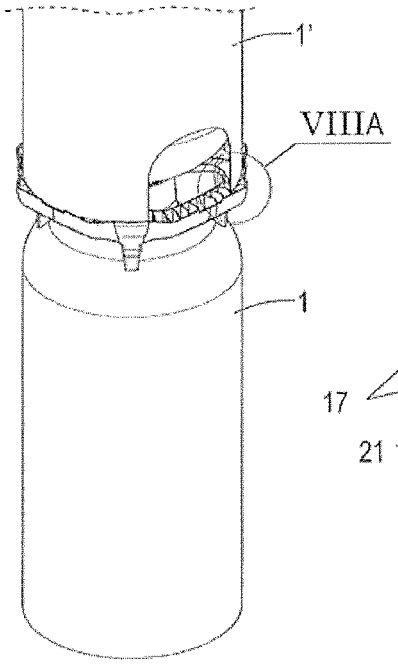
FIGS. 8 and 8A are perspective views of a stack of two container assemblies.
Figure 8A:
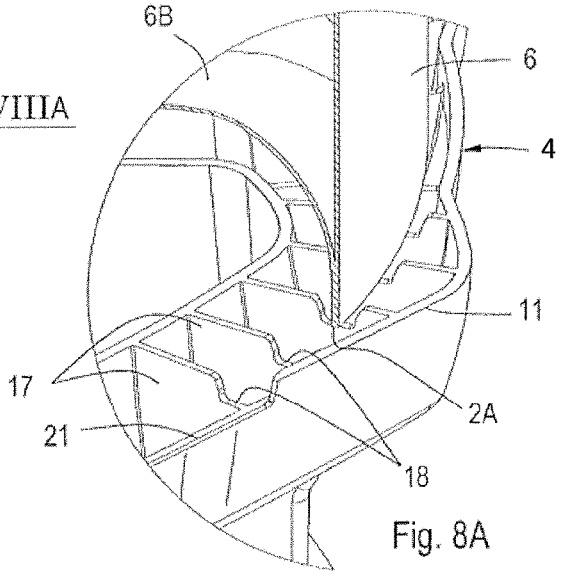

The upper surface of the chime is provided with an annular groove, in this example obtained by providing the upper edges of the baffles in the rim with notches 18, for accommodating the bottom rim of an identical container assembly, as shown in FIGS. 8 and 8A. The bottom walls of the spokes are provided with openings 19 to allow any liquids falling into the chime to drain. The side walls provide flat portions 20 or notches for accommodating a tensioning element, such as a flexible strip.

As, in top view, the four sides of the polygonal chime for abutting identical chimes of neighboring container assemblies are tangential to the circumference of the container, these sides are necessarily provided with cut-aways 21 to accommodate coinciding portions of the lower rim 2A of the container 2.

The shape of the bottom of the spokes corresponds to the shape of the upper part of the shell, which shell thus support the chime, e.g. when another container assembly is stacked on top of it.

Figure 6:
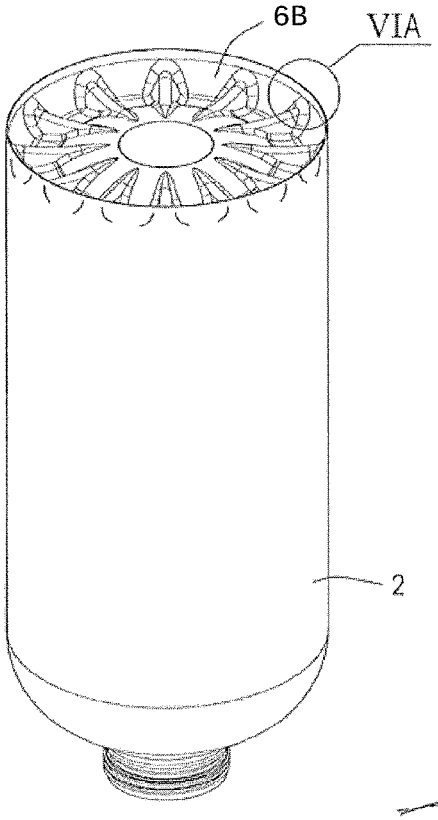
FIGS. 6 and 6A are perspective views of the container of the assembly shown in FIG. 1, in upside down position.
Figure 7:
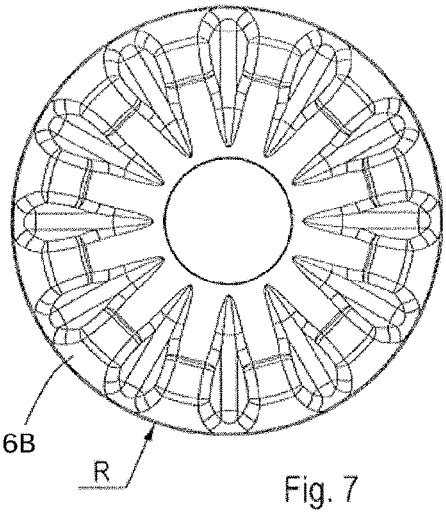
FIGS. 7 and 7A are bottom views of the container of the assembly shown in FIG. 1.
Figure 7A:
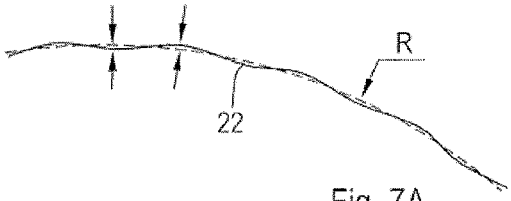
Figure 6A:
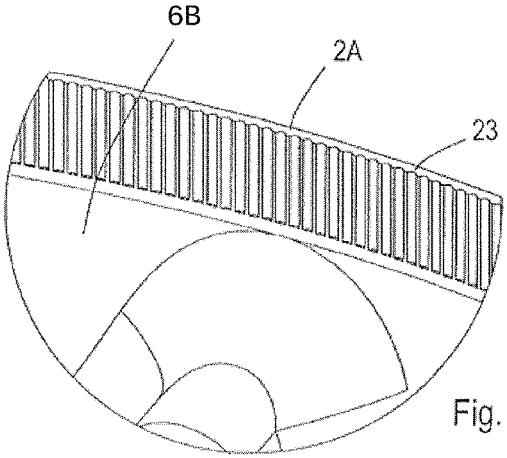

The bottom chime of the container assembly is shown in FIGS. 6 to 7A. The bottom part 6B of the shell is petaloid and is pressed, upside down, in the lower end of the upper part of the shell and fixed in place e.g. by cementing or ultrasonic welding. To further increase stability, it is preferred that, at the rim 2A, the wall undulates, as indicated by line 22 (in FIG. 7A) to increase its effective thickness and stiffness and/or the wall is actually thicker, preferably at least two times thicker, than the wall of the cylindrical section of the shell. In the embodiment shown, rigidity of the rim 2A is further increased by circumferential embossing 23.

In this example, the container has a net volume of 20 liters, an overall length of approximately 57 cm and a width of approximately 24 cm, yielding an L/D of 2,4. Thus, layers of 4×5 containers assemblies fit on a standardized Europallet (800×1200 mm).

Figure 9:
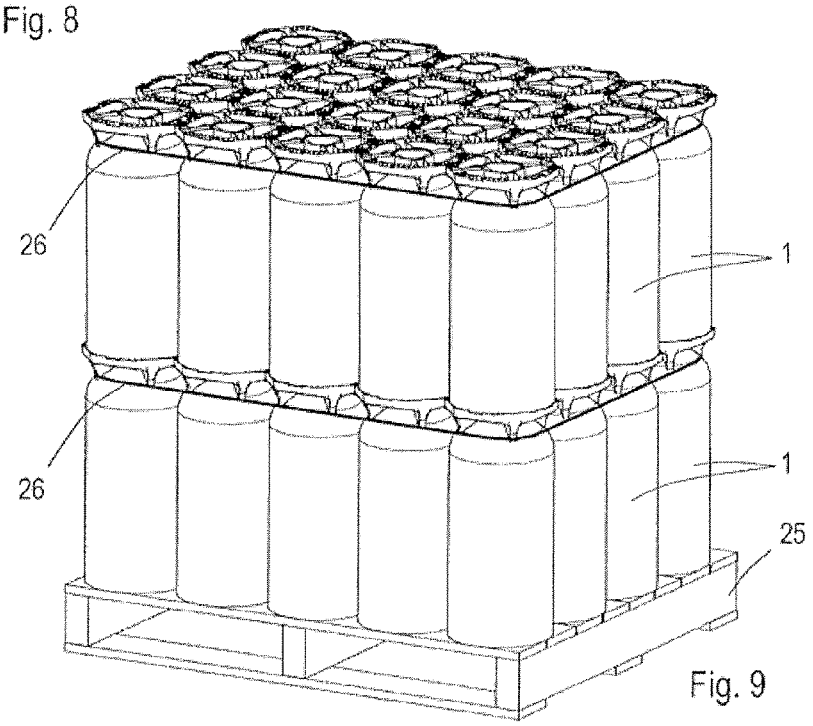
FIG. 9 is a perspective view of a pallet carrying two layers of (4×5) container assemblies filled with a liquid.

FIG. 9 shows such a pallet 25 carrying two layers of juxtaposed container assemblies holding a beverage, such as beer. The container assemblies in each of the layers are urged together by means of strap 26 tensioned about the chimes 4 of the outer container assemblies in the layer.

Figure 10:
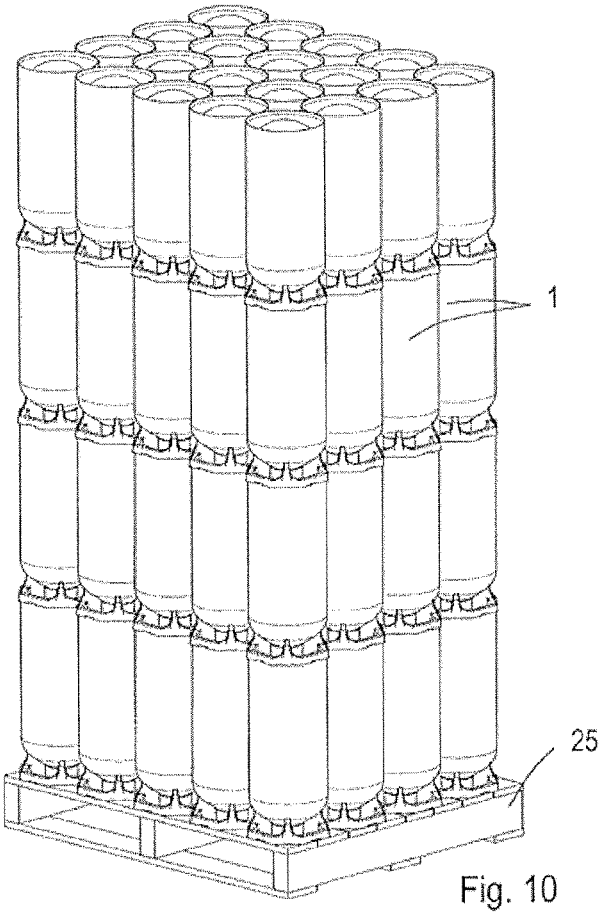
FIG. 10 is a perspective view of a pallet carrying four layers of (4×5) empty container assemblies.

FIG. 10 shows a pallet 25 carrying four layers of juxtaposed container assemblies. In this embodiment, the container assemblies are empty and positioned upside down. A sheet of a flexible material (not shown), in particular a polymer film, is present between the layers. By placing a next layer of container assemblies on a flexible sheet, the sheet will be deformed and draw the assemblies within the layers together.

Figure 11:
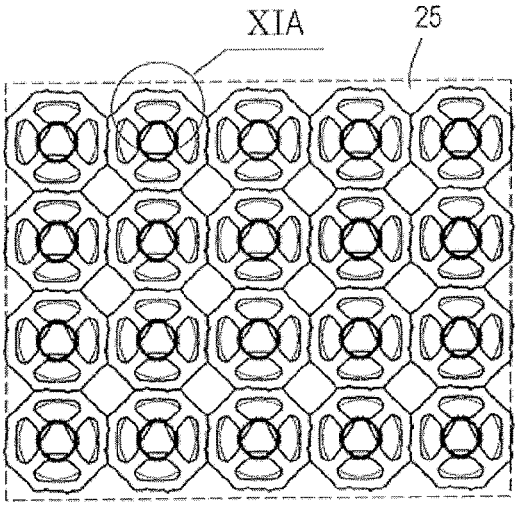
FIGS. 11 and 11A are top views of container assemblies.
Figure 11A:
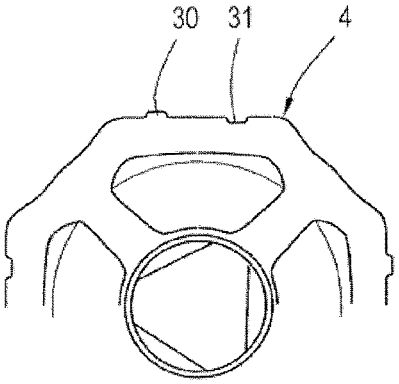

FIGS. 11 and 11A show a further embodiment of the container assembly, wherein the abutting sides of the chimes comprise self-complementary interlocking features, in this example a protrusion 30 and a corresponding recess 31 on each side.

The top chimes provide abutment and thus mutual support between the containers in a layer, suppressing rotation and translation (shifting) of the container assemblies relative to each other, in particular during transport.

The invention is not restricted to the above-described embodiments which can be varied in a number of ways within the scope of the claims.

The invention claimed is:

1. A container assembly for liquids comprising a container and a top chime fixedly attached to the container, the container having a valve assembly extending at least partially within the container, the top chime being positioned about the valve assembly, the valve assembly being configured to feed a propellant to and dispense a liquid from the container, wherein the top chime has a polygonal cross-section, the polygonal cross-section at least partially circumscribing a circular cross-section of the container and having sides configured for abutment with adjacent container assemblies to inhibit rotation of the container assembly when the adjacent container assemblies are stacked in one or more layers on a pallet.

2. The container assembly according to claim 1, wherein the polygonal cross-section comprises at least two pairs of parallel sides.

3. The container assembly according to claim 1, wherein at least two sides of the polygonal cross-section comprise self-complementary interlocking features.

4. The container assembly according to claim 1, wherein the container or the top chime includes a recess configured to accommodate a tensioning element.

5. The container assembly according to claim 1, wherein the top chime is a first chime, and wherein the container assembly further comprises a second chime carried by the container, wherein the first chime comprises a first annular rim and the second chime comprises an annular step or groove configured to accommodate a second annular rim, the first annular rim being identical to the second annular rim.

6. The container assembly according to claim 5, wherein the first annular rim undulates.

7. The container assembly according to claim 5, wherein one of the first chime and the second chime is disposed near or at a rim of the container and is embossed.

8. The container assembly according to claim 5, wherein at least one of the first and second chimes provides at least one grip configured to lift or manipulate the container assembly.

9. The container assembly according to claim 1 and further comprising a second container assembly, the second container assembly comprising a second container having a second valve assembly configured to feed a propellant to and dispense a liquid from the second container and a second top chime attached to the second container about the second valve assembly, wherein the second top chime has the polygonal cross-section and second sides abutting the sides of the container assembly in a complementary manner to inhibit rotation of the container assembly.

10. The container assembly according to claim 9, and further comprising a pallet wherein the container assembly and the second container assembly are stacked with other container assemblies in one or more layers on the pallet.

11. The container assembly according to claim 10, and further comprising an elongate tensioning element configured to urge together container assemblies in one of the layers on the pallet.

12. The container assembly according to claim 10, and further comprising a sheet of a flexible and/or plastically deformable material between the layers of container assemblies on the pallet.

13. The container assembly according to claim 10, wherein container assemblies in at least one of the layers on the pallet are empty and positioned upside down on the pallet with corresponding valve assemblies facing downwardly.

14. The container assembly of claim 2 wherein said at least two pairs of parallel sides extend at a right angle with respect to each other.

15. The container assembly of claim 3, wherein at least four sides of the polygonal cross-section comprise self-complementary interlocking features.

16. The container assembly according to claim 1, wherein the top chime is a separate element attached to the container about the valve assembly.

17. A container assembly for a liquid comprising:

a tubular container having an opening and a top chime coaxially positioned at one end of the tubular container, wherein the top chime is fixedly attached to the container and has sides with a polygonal outline, the polygonal outline at least partially circumscribing a circular radial cross-section of the tubular container such that all sides of the polygonal outline are tangential to said circular radial cross-section of the tubular container, and wherein the skies of the top chime are configured for abutment with adjacent container assemblies to inhibit rotation of the container assembly when the adjacent container assemblies are stacked in one or more layers on a pallet; and a valve assembly configured to feed a propellant to and dispense a liquid from the tubular container through the opening.

18. The container assembly of claim 17, wherein the top chime is a first chime and wherein the container assembly comprises a second chime coaxially positioned at an end of the tubular container opposite to the first chime, wherein the second chime is flush with the tubular container and does not radially extend beyond the tubular container.

19. The container assembly of claim 17, wherein the top chime is attached about the opening of the tubular container, the opening accommodating said valve assembly, the top chime having a top face leveled with a top face of the opening.

* * * * *